United States Patent [19]

Stevens

[11] Patent Number: 4,796,240

[45] Date of Patent: Jan. 3, 1989

[54] CARTRIDGE TIMEPIECE

[76] Inventor: Robert B. Stevens, Baltalimani Caddesi, Cami Sokak No. 5/3, Istanbul, Turkey

[21] Appl. No.: 132,819

[22] Filed: Dec. 14, 1987

[51] Int. Cl.[4] ..... G04B 37/00

[52] U.S. Cl. ..... 368/281; 368/276; 368/300

[58] Field of Search ..... 368/276–317

[56] References Cited

U.S. PATENT DOCUMENTS

| | | | |
|---|---|---|---|
| 410,945 | 9/1889 | Taft et al. | 368/298 |
| 4,674,891 | 6/1987 | Ritchie | 368/276 |
| 4,718,773 | 1/1988 | Odonoghue | 368/276 |

FOREIGN PATENT DOCUMENTS

| | | | |
|---|---|---|---|
| 05007 | 8/1986 | PCT Int'l Appl. | 368/281 |

*Primary Examiner*—Bernard Roskoski

*Attorney, Agent, or Firm*—Hurt, Richardson, Garner, Todd & Cadenhead

[57] ABSTRACT

The time indicator cartridge is attachable and detachable to the main timing mechanism through an engaging stem which connects the time indicia to the timing mechanism. A set of locking lugs squeezes the bezel within the casing of the time keeping mechanism which is secured by a rear insert camming device, thereby limiting the release of the cartridge to occur only on removal of the rear casing.

17 Claims, 2 Drawing Sheets

CARTRIDGE TIMEPIECE

BACKGROUND OF THE INVENTION

1. Field of the Invention

This invention relates to a timepiece of the type and size that one would carry on their person such as a wristwatch or a pocketwatch. The timepiece has a single casing which contains the timing mechanism, inner workings of a clock and interchangeable cartridges that contain the time indicating devices such as clock hands and a clock face. The cartridge can be snapped into or out of the casing easily. A cartridge snapped into a casing forms a unitary timepiece.

2. Description of the Prior Art

With respect to the prior art, the following U.S. patents are known: U.S. Pat. Nos. 4,525,077; 4,253,178; 1,469,735; 1,591,512 and 2,603,924.

U.S. Pat. No. 4,525,077 discloses a timepiece such as a pocket or a wristwatch having a large central opening through the watch center causing the watch to assume a toroidal configuration. The entire time mechanism and time display indication devices are contained within the toroidal configuration and the central opening formed is for the purpose of receiving interchangable decorative inserts which fit inside the central opening. The decorative inserts, however, do not perform any time keeping or time indicating functions, as all such mechanisms for performing these time functions are contained in and displayed on the surrounding timepiece.

Similar in nature is U.S. Pat. No. 1,591,512 where there is a watch case having ornamental plates which are removably mounted around the timepiece. The wearer of the watch changes the decor of the watch by interchanging the ornamental plates. Again the plates' only functions are decorative and have no relation or connection to the actual time indication function of the watch.

Also known and disclosed in the prior art are decorative mountings for timepieces as in U.S. Pat. No. 2,603,942 which discloses a single timepiece unit mounted inside an ornamental holder. The holder contains a means to mount the timepiece, but again, the purpose is strictly ornamental. Similarly, U.S. Pat. No. 4,253,178 discloses an ornamental device which is a removable/attachable device for a watch or timepiece.

Finally, U.S. Pat. No. 1,469,735 discloses an item which is useful for a pocket watch style timepiece where a decorative filler ring is placed inside the pocket watch casing so that it may accommodate timepieces of different sizes.

None of the above patents, teach the objectives of the present invention, that is to provide a single time mechanism which operates interchangeable time indicator cartridges. The cartridges may include ornamental design, but can be limited to strictly functional purposes. The known prior art merely provides a means for changing ornamental decor which has no relation to the time keeping function of the watch.

SUMMARY OF THE INVENTION

The preferred exemplary embodiment of the timepiece as described in detail herein, is characterized by a time indicator cartridge which is detachable from the time keeping mechanisms of the timepiece. The several different time indicator cartridges are interchangeable with the single main time keeping mechanism. In the exemplary form, the time indicator cartridge is of circular form with the clock face and time indicators are held within a clock crystal and bezel. The time indicator cartridge is attachable and detachable to the main timing mechanism through an engaging stem which connects the time indicia to the timing mechanism. A set of locking lugs squeezes the bezel within the casing of the time keeping mechanism which is secured by a rear insert camming device, thereby limiting the release of the cartridge to occur only on removal of the rear casing cover.

The primary objective of the invention is to allow the wearer of a watch or timepiece flexibility in selecting clock face styles by allowing the wearer to purchase one time keeping mechanism and several interchangable time indicator cartridges in different styles and qualities to suit several different occasions. Another object of the invention is to achieve an inexpensive way of replacing scratched and broken watch crystals without having to disassemble an entire timepiece.

While the invention disclosed shows a method of analog time display, it can be adapted as well to digital time display with variation to the time indicator cartridge.

Other advantages of the cartridge time piece of the present invention will become apparent.

DETAILED DESCRIPTION OF THE PREFERRED EMBODIMENTS

A preferred exemplary embodiment of the invention is illustrated in FIGS. 1–4 wherein like numerals represent like parts. In this form of the invention, the cartridge timepiece is attached to a wrist watch band. The invention is not limited to such device, but could also take the form of a locket, necklace, pocket watch or numerous other forms of wearing a timepiece.

Figure 1:
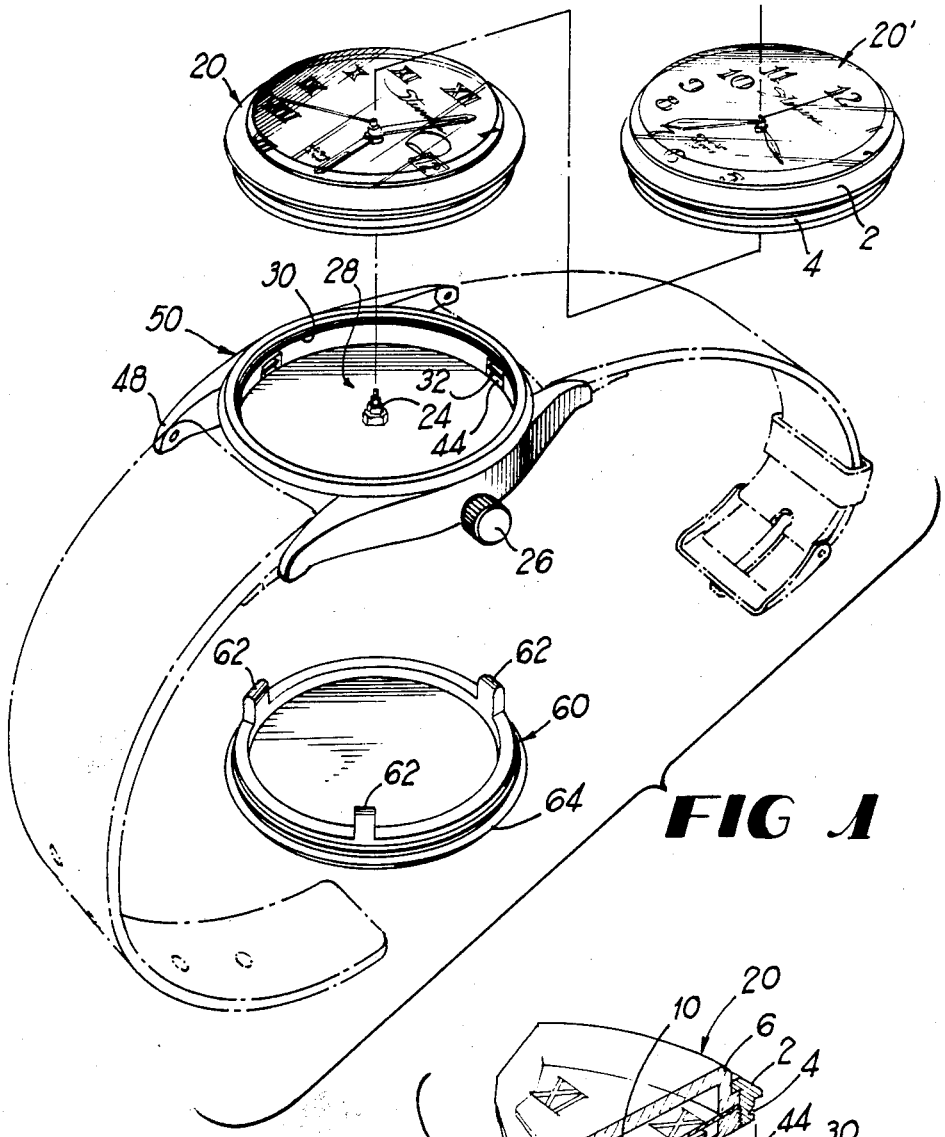
FIG. 1 is a perspective, partially disassembled view of a timepiece made in accordance with the present invention showing alternate cartridges for indication of time and their relationship to a central cartridge casing and a locking device. The particular embodiment shown is such that would be attached to a watch band.

FIG. 1 shows a timepiece in accordance with the present invention. The timepiece includes a central cartridge casing 50 which in this particular embodiment is capable of being attached to a wrist band shown in phantom lines via a mounting and pin device 48. FIG. 1 also discloses two fully assembled time indicator cartridges 20 and 20'. The alternate time indicator cartridges 20 and 20' each contain a particular clock face design, the former containing a clock face with Roman numerals and a day/date window, the latter with Arabic numerals and no date indication device. Either cartridge fits interchangeably inside the central cartridge casing 50 demonstrating the invention's unique characteristic of providing interchangeable time indicator cartridges. The selected, fully assembled time indicator cartridge fits inside depression 28 of the central cartridge casing 50, over a tiered engaging stem 24 which connects the time indicator cartridge to the central cartridge casing by extending up into the rear side of the time indicator cartridge 20. A rear locking device 60 is also disclosed, which locks the time indicator cartridge 20 inside the central cartridge casing 50 from the rear surface of the assembled timepiece.

Figure 2:
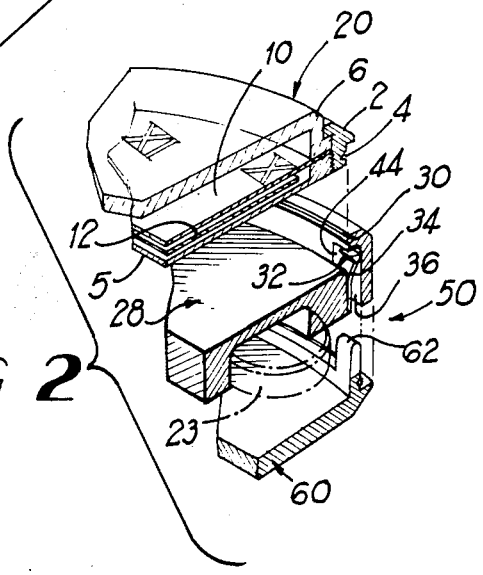
FIG. 2 is an exploded perspective view of a cross sectional segment of the timepiece device.

FIG. 2 shows a more detailed view of the method in which the rear locking device 60 holds the time indicator cartridge 20 inside the central cartridge casing 50. The rear locking device 60 consists of at least of a rim 64 of about the same size and shape as the outline of the central cartridge casing 50. Extending vertically from the rim 64 are one or more cams 62. The central cartridge casing 50 contains a corresponding number of cam shafts 36, that extend from the rear surface of the central cartridge casing upward, to that of the number of cams 62. The cam shaft 36 contains inside, a springing camming surface 34 with a locking lug 32 extending from the top of the camming surface 34. The camming surface 34 lies at rest against the most outward wall of the cam shaft 36. When a cam 62 is inserted into a cam shaft 36, the camming surface 34 is pushed inward forcing a locking lug 32 through an aperture 44 in the side wall of depression 28 of the central cartridge casing 50. When a time indicator cartridge, such as 20 or 20' is inserted, the locking lug 32 engages a groove 4, cut into the bezel 2, that surrounds the time indicating cartridge 20 or 20'. An O-ring seal 30 around the perimeter edge of depression 28 finishes the bond between the selected time indicator cartridge and the central cartridge casing 50. Thus, the time indicator cartridge 20 or 20' is locked inside the central cartridge casing 50 and release is only possible by removal of the rear locking device 60 by prying it apart from the central cartridge casing. Also shown are the base 5 and crystal 6 of the time indicator cartridge.

Figure 3:
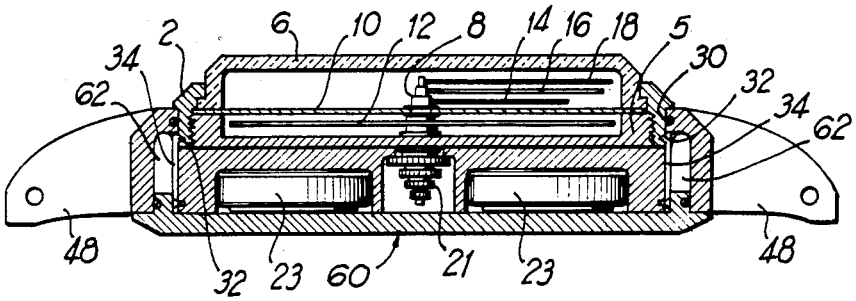
FIG. 3 is a planar cross section of the assembled timepiece device.

FIG. 3 gives a more detailed view of the integration of the three main components to form a single timepiece unit. The cross-section of the timepiece fully assembled reveals the method in which the time keeping mechanism drvies the time indicators. This view reveals batteries 23 and sprocket wheels 21 which are connected to a conventional time keeping mechanism (not shown) underneath depression 28 within the central cartridge casing 50. The sprocket wheels 21 are attached to the lower portion of an engaging stem 24 and a time setting stem 26. The sprocket wheels 21 when driven by the time keeping mechanism rotate the upper individual tiers of the engaging stem 24 independently.

Figure 4:
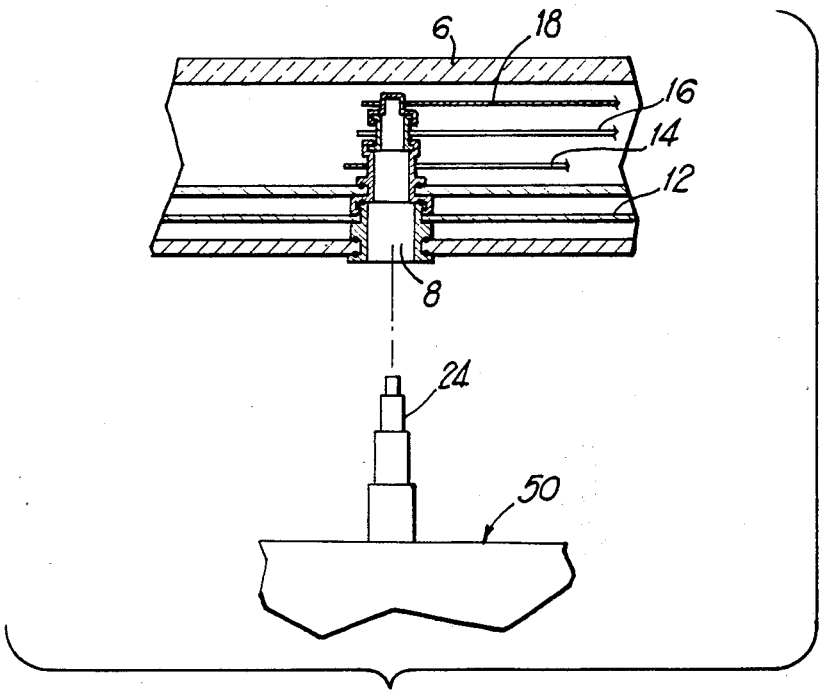
FIG. 4 is a detailed cross section of the engagement device in relation to the display cartridge.

FIG. 4 illustrates an enlarged detail of the upper portion of engaging stem 24 which is inserted into the tiered engaging stem shaft 8 for receiving the engaging stem 24 which extends into the time indicator cartridge 20 through the cartridges base 5. The time indicator cartridge contains all of the output devices for indicating time including, but not limited to, an hour hand 14, a minute hand 16 and a clock face 10. Other output devices depicted are a second hand 18 and a day/date wheel 12. While these devices are not essential to indicate time, different time indicator cartridges depending upon their style may or may not include a particular indication device. In the preferred embodiment depicted, the clock face and time indicator cartridge has 4 output time indicating devices, an hour hand 14, a minute hand 16 and second hand 18 which are positioned around the tiered engaging stem shaft 8 above the stationary clock face 10, and a day and date wheel 12 below the clockface 10. A clear crystal 6 covers the time indicating devices. In the particular embodiment there are four tiers and four associated output time indicator devices, however, the number of output devices on a particular time indicator cartridge are maximally limited by the number of rotating tiers on the engaging stem 24. Each tier of the engaging stem shaft rotates with the associated tier of the engaging stem 24 by assuming an interlocking fit by either a sprocket design or a multi-sided outer perimeter of the engaging stem 24 within the like shape and size of the inner perimeter of engaging stem shaft 8. An octagonal and a four sided engaging stem 24 are depicted respectively in FIGS. 1 and 4.

In order to engage or disengage the time indicator cartridge 20 from the central cartridge case in 50, in the depicted embodiment, all output time indicating devices need to be set to an arbitrary (preferably 12:00) zero position, so that at the zero position all of the tiers of the engaging stem shaft 8 are in alignment. Otherwise, reinsertion of the clock face and time indicator cartridge is not possible. This can be achieved through the time setting stem 26 before disengagement.

Once the timing mechanism is engaged to the time indicator cartridge 20 or 20' through the engaging stem 24 the clock face and time indicator cartridge 20 or 20' is locked inside depression 28 of the central cartridge casing by means of locking lugs 32 exerting pressure on a groove 4 cut around the bezel 2.

The timepiece cartridge device can be altered in various ways within the basic concepts of the invention. In particular, it is possible to alter the number of tiers of the engagement stem 24 and engaging shaft 8 to rotate fewer or more output time indicating devices about the engaging shaft and stem's central axis.

Also, the shape of the engaging stem can be varied with a sprocket design, square stem, or any multi-sided shaped stem. The shape of the time indicator cartridge can be varied but must correspond with the individual central cartridge case.

The rear locking device may also consist of a cover plate and/or be attached to the central cartridge casing by a hinge mechanism rather than merely snapping into position.

I claim:

1. A timepiece comprising:

a central cartridge casing having a time keeping mechanism for driving a clock, a depression formed within said central cartridge casing, an engaging stem extending from said time mechanism and from said depression, and a releasable securing means connected to said casing;

a cartridge including time indicator means, a transparent shield means for protecting the time indicator means, a bezel and a shaft for receiving said engaging stem, the cartridge being shaped to be received within the casing depression; and a locking means for engagement with said releasable securing means to lock the cartridge within the casing depression.

2. A timepiece as recited in claim 1 wherein said time mechanism further includes an external time setting stem connected to said engaging stem for adjusting the position of said engaging stem.

3. A timepiece as recited in claim 1 wherein said engaging stem is comprised of a multitude of tiers of varying upwardly decreasing diameters each of said tiers being driven by the time keeping mechanism whereby each of said tiers are rotated independently and at varying speeds.

4. A timepiece as recited in claim 3 wherein said individual tiers take on an outer perimeter shape other than a circular shape.

5. A timepiece as recited in claim 1 wherein said shaft for receiving engaging stem assumes a shape and size of like proportion to that of said engaging stem and said engaging stem fits within said shaft for receiving the engaging stem in an interlocking fashion.

6. A timepiece as recited in claim 3 wherein said rotating time indicator means is connected to said engaging stem where each said time indicator is connected to said tier of said engaging stem.

7. A timepiece as recited in claims 6 and 3 wherein said rotating time indicator means is driven by said engaging stem.

8. A timepiece as recited in claim 1 wherein said time indicator means of said cartridge is comprised of a stationary clock face, an hour hand rotating, and a rotating minute hand.

9. A timpiece as recited in claim 8 wherein said time indicator means is further comprised of a rotating second hand and a rotating day/date wheel.

10. A timepiece as recited in claim 1 wherein said time indicator means is a clock face with a digital display representing time.

11. A timepiece as recited in claim 1 wherein said depression formed within said central cartridge casing contains a sealing means around the inner edge of said depression fitting between said cartridge and said central cartridge casing.

12. A timepiece as claimed in claim 1 wherein said releasable securing means of said central cartridge casing is comprised of at least one cam shaft extending from its rear surface, a springing camming surface situated inside said camshaft, a locking lug attached to the uppermost inward portion of said camming surface, and an aperture by which said locking lug communicates with said depression of said central cartridge casing.

13. A timepiece as claimed in claim 12 wherein said rear locking means consists of a rim with a corresponding number of cams extending from said rim as the number of said cam shafts in said central cartridge casing.

14. A timepiece as claimed in claim 13 wherein said releasable securing means is activated by inserting said cam in said camshaft behind the springing caming surface pushing forward the springing camming surface and pushing said locking lug through said aperture where said locking lug engages said cartridge.

15. A timepiece as claimed in claim 1 wherein said central cartridge casing has a front cover means.

16. A timepiece as claimed in claim 1 wherein said central cartridge casing is further comprised of a means to engage a watch band.

17. A timepiece as claimed in claim 1 wherein the central cartridge casing has a chain means attached at least at one point.

* * * * *

UNITED STATES PATENT AND TRADEMARK OFFICE

CERTIFICATE OF CORRECTION

PATENT NO. : 4,796,240

DATED : January 3, 1989

INVENTOR(S) : Robert B. Stevens

It is certified that error appears in the above-identified patent and that said Letters Patent is hereby corrected as shown below:

On the Title Page, Item [76], "Baltalimani Caddesi, Cami Sokak No. 5/3, Istanbul, Turkey" should read --P. O. Box 36222
Grosse Pointe, MI 48236--.

Signed and Sealed this

Twenty-second Day of August, 1989

*Attest:*

DONALD J. QUIGG

*Attesting Officer*

*Commissioner of Patents and Trademarks*